United States Patent [19]

Atwood

[11] Patent Number: 4,660,301

[45] Date of Patent: Apr. 28, 1987

[54] HEEL PROTECTOR

[76] Inventor: Steven C. Atwood, 9220 Clarewood, #1013, Houston, Tex. 77036

[21] Appl. No.: 863,354

[22] Filed: May 15, 1986

[51] Int. Cl.[4] ..... A43B 13/22

[52] U.S. Cl. ..... 36/72 B; 36/72 R

[58] Field of Search ..... 36/72 R, 72 B, 73, 136, 36/34 B

[56] References Cited

U.S. PATENT DOCUMENTS

| | | | |
|---|---|---|---|
| 630,726 | 8/1899 | Morrow . | |
| 1,274,692 | 8/1918 | Davis | 36/72 B |
| 1,345,875 | 7/1920 | Peters | 36/72 B |
| 1,398,627 | 11/1921 | Combs | 36/72 B |
| 1,670,575 | 10/1925 | Huss . | |
| 1,691,582 | 11/1927 | Nowak . | |
| 1,888,609 | 11/1932 | Sankey | 36/72 R |
| 1,955,159 | 4/1934 | Winget | 36/72 B |
| 2,023,580 | 12/1935 | Fullarton | 36/72 R |
| 3,095,659 | 7/1963 | McClellan | 36/72 B |
| 3,217,430 | 11/1965 | Novick | 36/72 B |
| 3,319,362 | 5/1967 | Gomolka | 36/72 R |
| 4,441,264 | 4/1984 | Hantz-Guibas et al. | 36/72 R X |
| 4,459,764 | 7/1984 | Beck | 36/72 B |

FOREIGN PATENT DOCUMENTS 778586 12/1934 France .

*Primary Examiner*—Louis K. Rimrodt
*Assistant Examiner*—T. Graveline
*Attorney, Agent, or Firm*—Norvell & Associates

[57] ABSTRACT

A metal boot protector includes a U-shaped wire rod and a correspondingly-shaped plate for protecting the rearward upper portion of the boot while the user is driving a vehicle. The rod fits snugly in a crease between the sole and the upper portion of the boot. The plate includes an outwardly extending bevel along its upper edge, and the plate sides moving upward from the rod to the bevel extend outwardly from a vertical plane passing through the rod center, and then are contoured inwardly of the plane to prevent debris from becoming lodged between the guard and the boot.

17 Claims, 5 Drawing Figures

HEEL PROTECTOR

FIELD OF THE INVENTION

The present invention relates to footwear attachments for protecting the rear portion of footwear and, more particularly, relates to a clip-on guard for protecting the rear upper portion of a shoe or boot on the foot of a vehicular driver.

BACKGROUND OF THE INVENTION

Various guards have been devised for protecting the rearward end of footwear. When operating an automobile, for instance, the back portion of the driver's shoe generally rests on the floor of the vehicle, and becomes scuffed due to rubbing along the floor. Shoe polish loses its brilliance and, more importantly, expensive shoes or boots may become quickly damaged when dirt or grit on the floor wear through or otherwise damage the upper portion of the shoe or boot.

Early devices for protecting footwear were often designed to protect only the heel of the shoe or boot, as shown for example in U.S. Pat. No. 1,670,575. Other devices, as shown in U.S. Pat. No. 1,691,582, were specifically designed for ladies' shoes, and included a strap for securing around the front of the heel and thereby securing the protective device to the shoe. French Pat. No. 778,586 illustrates an extending shelf affixed to a U-shaped heel member.

Other shoe guards are designed to fit under the heel of the shoe to hold the shoe in place, e.g. guards described in U.S. Pat. Nos. 4,459,764, 3,217,430, and 630,726. Such guards often are not preferable because dirt and debris can lodge between the heel and the guard, causing discomfort or damage to the shoe. Moreover, the device is awkward for many users to wear while walking, since the sound and feel of the shoe is altered by the guard.

The significant problem with prior art shoe guards relates to the difficulty of snugly attaching the guard to a wide variety of shoes of boots. Moreover, some guards are permanently secured to the shoe, or are difficult and time consuming to remove. Other guards tend to cut or otherwise damage the shoe upper by abrasion. Many shoe or boot guards do not adequately protect against small stones, dirt, and other debris from becoming lodged between the guard and the upper, thereby damaging the shoe or boot.

As shown in U.S. Pat. Nos. 4,441,264 and 3,095,659, some shoe guards include a slightly curved rear portion, but these guards are difficult to properly and snugly secure to a wide variety of shoes. Moreover, the guards do not adequately protect against dirt and debris becoming lodged between the guard and the upper portion of the shoe or boot.

The disadvantages of the prior art are overcome by the present invention, and an improved shoe guard is hereinafter disclosed.

SUMMARY OF THE INVENTION

An improved shoe or boot protector is provided, preferably fabricated from either metal or a strong plastic material. A generally U-shaped wire rod is provided for fitting in the crease between the shoe sole (or heel) and the upper portion of the shoe or boot. A plate member having a generally U-shaped cross-sectional configuration is secured to the rod, and includes an outward extending bevel along its upper edge. A generally vertical plane passing continually through the plate preferably extends through a vertical plane passing through the centerline of the rod at a position immediately above the upper surface of the rod to enable a snug fit while not cutting or otherwise damaging the upper portion of the shoe or boot.

The sides of the U-shaped plate each preferably extend outwardly from a plane perpendicular to the plane of the rod, and then are contoured inwardly so that at least an upper portion of each side is inward of the plane perpendicular to the plane of the rod. Gravel or other debris are thereby prevented from becoming lodged between the protective plate and the upper portion of the shoe or boot.

DETAILED DESCRIPTION OF THE PREFERRED EMBODIMENT

Figure 1:
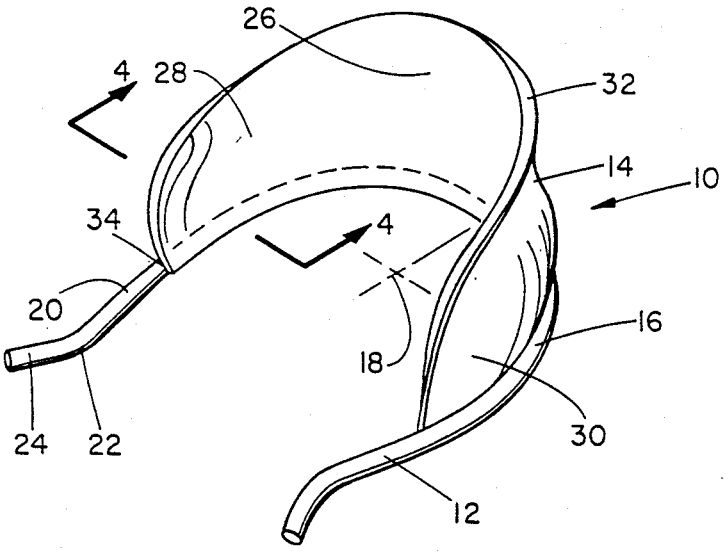
FIG. 1 is a pictorial view of a suitable shoe guard according to the present invention.

A suitable footwear guard fabricated from metal stock is depicted in FIG. 1 for preventing damage to the leather (other expensive material) upper portion of a shoe or boot. The guard may typically be worn by a vehicular driver and will protect the upper rearward portion of the shoe or boot in a manner as shown, for example, in FIG. 1 of U.S. Pat. No. 4,459,764.

FIG. 1 illustrates shoe guard 10 comprising a U-shaped metallic rod member 12 and a metallic sheet material 14 also formed in a generally U-shaped cross-sectional configuration. Rod member 12 comprises a rearward generally circular-shaped portion 16 having center 18, a pair of slightly inward extending leg portions 20, and a pair of outward extending members 24 each joined to a respective member 20 at bend 22. The entirety of the rod member 12 preferably lies in a single plane, and typically is formed from ⅛ inch diameter steel rod.

Sheet material 14 comprises a rearward portion 26 and substantially similar side portions 28 and 30 discussed subsequently in greater detail. The lower edge of 14 is substantially in the plane of the rod member 12, and is joined thereto at 34 by a weld, fused bond, or other suitable securing material. The upper edge of 14 slopes downward toward rod 12 moving from portion 26 toward the front end of the guard, and includes an outward bevel 32 along preferably the entirety of the upper edge. Bevel 32 typically has a radius of between 1/16 inch and ⅛ inch, and prevents the upper edge of 14 from chaffing or otherwise cutting into the leather material of the shoe or boot. Sheet 14 is typically fabricated from 20 gauge low carbon sheet material.

Figure 2:
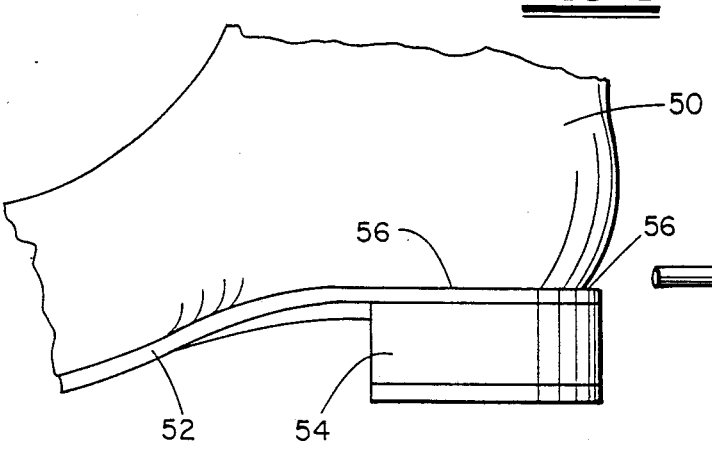
FIG. 2 is a side view of the guard shown in FIG. 1 in a position for applying to a boot.
Figure 2:
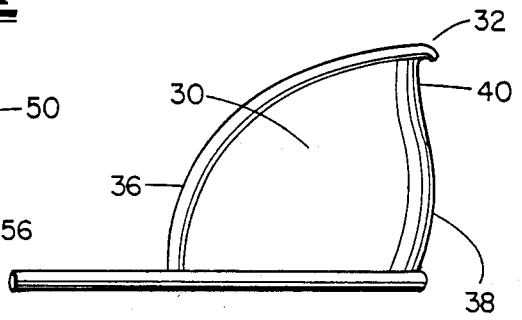

FIG. 2 illustrates how device 10 may be secured to a shoe or boot 50 having a standard sole 52 and heel 54. A crease 56 normally extends between sole 52 and the upper leather of the boot, and rod 12 fits within the crease to secure the device to the boot. During installation, rod 12 would typically be placed in the crease 56 and gradually pushed onto the boot, expanding members 20 outwardly past the heel portion of the boot and then returning partially inwardly at a position adjacent the instep portion of the boot. Members 24 both prevent the rod from damaging the boot during installation and assist in removal of the guard from the boot.

FIG. 2 also illustrates the preferred curvature of rearward portion 26. With respect to the circle center 18 and moving upward from the plane of rod 12, the sheet material is curved slightly outwardly so that a portion 38 is radially outwardly of the rod portion 16, and then is curved slightly inwardly so that portion 40 is radially inwardly of rod portion 16. The top bevel 32, previously described, is also shown in FIG. 2.

Figure 3:
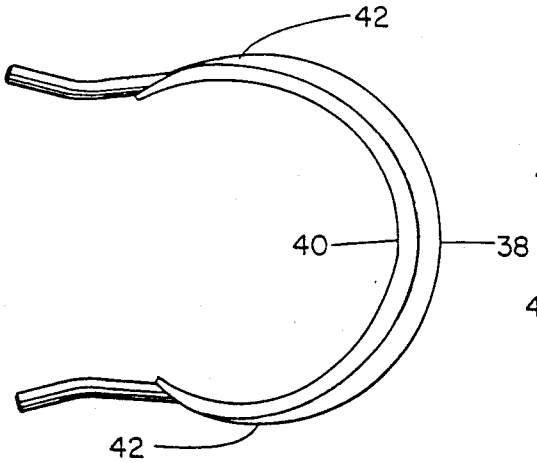
FIG. 3 is a top view of the guard shown in FIG. 1 with the top bevel removed for clarity.

FIG. 3 illustrates the preferred configuration of the side portions 28 and 30. For the sake of clarity, the top bevel 32 on the upper surface 36 of sheet material 14 is not shown in FIG. 3. With respect to a vertical plane equidistant between portions 20 and passing through the circle center 18, each of the sides 28 and 30 preferably curve slightly outwardly as one moves upward from the horizontal plane of rod 12, so that a portion 42 is radially outward from the rod portion 16 (spaced fruther from the above described vertical plane than the center of rod portion 16), and is then curved slightly inwardly so that a portion 44 is radially inward of the rod portion 16 (spaced closer to the above described vertical plane than the center of rod portion 16). FIG. 3 thus clearly illustrates a feature of the invention, namely that an upper portion of the sides of the sheet material 14 are positioned at a closer spacing than the corresponding portions of the rod member directly beneath these portions.

The curvature of sheet material 14 as described above serves to both assist in securing the guard 10 to the boot and prevents gravel and other debris from becoming lodged between the guard and the boot. The curvature provides a comfortable fit to the user, and once installed, the guard is less likely to slip or shift with respect to the boot than prior art guards. Moreover, this snug fit is provided without sharp edges which may damage the boot either during installation, removal, or use.

Figure 4:
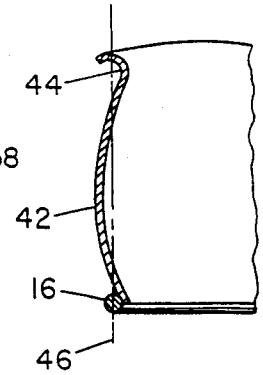
FIG. 4 is a cross-sectional view of a portion of the guard shown in FIG. 1.

FIG. 4 illustrates a cross-sectional view of a portion of the guard shown in FIG. 1, and further shows the above-described curvature of the sides of the boot 14. Rod 14 substantially lies in a plane, which may be characterized as a horizontal plane, so that vertical plane 46 is perpendicular to the horizontal plane passing through the axial length of rod 12. Portion 42 is thus outwardly of plane 46 which passes through the axis of the rod, while portion 44 is inwardly of plane 46.

It is also a feature of the present invention that the sheet material 14 engage the rod 12 at a position substantially adjacent the upper surface of rod 12 as compared, for example, to either the inner or outer surface of rod 12. As shown in FIG. 4, material 14 first engages rod 12 at a position substantially adjacent plane 46. In other words, a substantially vertical plane passing through the outer surface of sheet material 14 passes through or closely adjacent plane 46 at a position immediately above the upper surface of rod 16. This enables the rod to effectively seat within the crease 56, yet still provides the desired snug fit between the plate 14 and the boot in the area immediately above the rod to prevent debris from becoming lodged between the boot and the guard.

Figure 5:
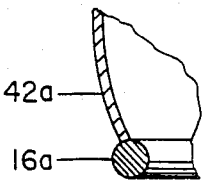
FIG. 5 is a cross-sectional view of an alternate embodiment of the apparatus shown in FIG. 4.

FIG. 5 illustrates an alternate embodiment of the attachment between the sheet material 14 and rod 12, and also illustrates the above preferred construction. In FIG. 5, material **42*a* is affixed directly to the upper surface of rod 16*a***, and does not extend along the inner surface of the rod.

It should thus be understood that the guard according to the present invention may be easily installed and removed from a boot without damaging the boot, and that the guard will substantially increase the life of a shoe or boot of a vehicular driver. The same guard may be used for various sizes and shapes of shoes or boots, and may, if desired, be utilized on one or both boots of the user. Although not essential, a felt material pad may be provided on the inner surface of the sheet material 14 for engaging the leather upper of the shoe or boot, and various types of engravings or other design material may be imprinted on or attached to the outer surface of sheet material 14, especially in the area of rearward portion 26. It is a feature of the present invention, however, that sheet material 14 be solid, so that no spaces be provided, especially in the area of portion 26, through which gravel, dirt, and other debris can contact the portion of the boot to be protected.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed or desired to be secured by Letters Patent is:

1. A guard of a type having a generally U-shaped configuration for protecting a rearward portion of footwear including a crease between a sole and upper portion of the footwear, the guard remaining out of engagement with a walking surface while worn by the user, comprising:

a generally U-shaped metallic rod member for fitting engagement in the crease between the sole and the upper portion of the footwear for exerting a compressive force sufficient to removably secure the guard to the rearward portion of the footwear; and a metallic sheet material secured to the metallic rod member and having a generally U-shaped cross-sectional configuration and permanently secured to the rod member for covering the rearward portion of the upper portion of the footwear, the sheet material including a pair of side portions and a rearward portion having a first lower curvilinear portion extending outwardly from the rod member and a second upper curvilinear portion extending inwardly from the rod member with respect to a center of the rod member, and further including a bevel along an upper surface thereof having an outwardly protruding edge surface for preventing the sheet material from damaging the upper portion of the footwear.

2. A guard as defined in claim 1, wherein the rod member has a circular cross-sectional configuration.

3. A guard as defined in claim 1, wherein the rod member further comprises:

a rearward circular-shaped portion;

a pair of inwardly extending members each secured to the circular-shaped portion; and a pair of outwardly extending members each secured to a respective inwardly extending member.

4. A guard as defined in claim 1, wherein each of the pair of side portions comprises:

a third lower curvilinear portion extending outwardly from the rod member and a fourth upper curvilinear portion extending inwardly from the rod member with respect to a vertical plane equidistant between the side portions and passing through the center of the circular-shaped rod member.

5. A guard as defined in claim 1, wherein an outer surface of a lower portion of the sheet material passes through a vertical plane perpendicular to the plane of the rod member at a position substantially adjacent an upper surface of the rod member.

6. A guard as defined in claim 1, wherein said sheet material is welded to said rod member.

7. A guard as defined in claim 1, wherein an outer surface of a lower portion of the sheet material passes through a vertical plane perpendicular to the plane of the rod member at a position substantially adjacent on upper surface of the rod member.

8. A boot guard of a type having a generally U-shaped configuration for protecting a rearward portion of footwear including a crease between a sole and upper portion of the footwear, comprising:

a generally U-shaped rod member for fitting engagement in the crease between the sole and the upper portion of the footwear for creating a compressive force sufficient to removably secure the guard to the rearward portion of the footwear;

a metallic sheet material having a generally U-shaped cross-sectional configuration permanently secured to the rod member for protecting the rearward portion of the upper portion of the footwear; and a pair of side portions of the sheet material each including a first lower curvilinear portion extending outwardly from the rod member and a second upper curvilinear portion extending inwardly from the rod member with respect to a vertical plane equidistant between the side portions and passing through a center of a circular-shaped portion of the rod member.

9. A boot guard as defined in claim 8, further comprising:

a rearward portion having a third lower curvilinear portion extending outwardly from the rod member and a second upward curvilinear portion extending inwardly from the rod member with respect to the center of the circular-shaped portion of the rod member.

10. A boot guard as defined in claim 8, wherein an outer surface of a lower portion of the sheet material passes through a vertical plane perpendicular to the plane of the rod member at a position substantially adjacent an upper surface of the rod member.

11. A boot guard as defined in claim 8, wherein the rod member comprises:

a rearward circular-shaped portion;

a pair of inwardly extending members each secured to the circular-shaped portion; and, a pair of outwardly extending members each secured to a respective inwardly extending member.

12. A boot guard as defined in claim 8, wherein the sheet material further comprises:

a bevel along at least a substantial portion of an upper surface of the sheet material and having an outwardly protruding edge surface for preventing the upper surface from damaging the boot.

13. A footwear guard of a type having a generally U-shaped configuration for protecting a rearward portion of footwear including a sole and an upper portion while remaining out of engagement with a walking surface while worn by the user, comprising:

a generally U-shaped rod member including a circular-shaped end portion for fitting engagement in a crease between the sole and the upper portion of the footwear for exerting a compressive force sufficient to removably secure the guard to the footwear; and a metallic sheet material having a generally U-shaped cross-sectional configuration secured to the rod member for protecting a rearward portion of the upper portion of the footwear and including (a) a bevel along an upper surface thereof having an outwardly protruding edge surface for preventing the upper surface from damaging the upper portion of the footwear, and (b) a first lower curvilinear portion extending outwardly from the rod member and a second upper curvilinear portion extending inwardly from the rod member with respect to a center of the circular-shaped rod portion.

14. A footwear guard as defined in claim 13, wherein the rod member has a circular cross-sectional configuration.

15. A footwear guard as defined in claim 13, wherein the rod member further comprises:

a pair of inwardly extending members each secured to the circular-shaped portion; and a pair of outwardly extending members each secured to a respective inwardly extending member.

16. A footwear guard as defined in claim 13, wherein outer surface of a lower portion of the sheet material passes through a vertical plane perpendicular to the plane of the rod member at a position substantially adjacent an upper surface of the rod member.

17. A footwear guard as defined in claim 13, wherein both the rod member and sheet material are permanently secured by a weld.

* * * * *